United States Patent [19]

Hammarstrand

[11] 4,046,026

[45] Sept. 6, 1977

[54] LINKAGE AND MOTION SYSTEM, ESPECIALLY FOR ACCOMPLISHING A SWINGING MOVEMENT IN EQUIPMENT SUCH AS BUCKETS FOR POWER SHOVELS AND THE LIKE

[75] Inventor: Sten Ove Hammarstrand, Hudiksvall, Sweden

[73] Assignee: Sveska Hymas Aktiebolag, Hudiksvall, Sweden

[21] Appl. No.: 646,495

[22] Filed: Jan. 5, 1976

[30] Foreign Application Priority Data

Jan. 8, 1975 Sweden ..... 7500175

[51] Int. Cl.[2] ..... G05G 1/04

[52] U.S. Cl. ..... 74/519; 214/778; 214/140

[58] Field of Search ..... 74/519, 521, 522, 522.5; 214/778, 765, 140, 146 R, 146 E

[56] References Cited

U.S. PATENT DOCUMENTS

| | | | |
|---|---|---|---|
| 3,197,050 | 7/1965 | Shumaker | 214/778 |
| 3,786,953 | 1/1974 | Crum et al. | 214/778 X |

*Primary Examiner*—Allan D. Herrmann
*Assistant Examiner*—Frank H. McKenzie, Jr.
*Attorney, Agent, or Firm*—Kurt Kelman

[57] ABSTRACT

A linkage and motion system pivoted to a bracket comprises a first linkage connecting the bracket with a second linkage, a holder connected to the bracket and to the second linkage, and a drive with a linear working motion connected to the bracket. The articulated connection of the drive to the bracket is spaced from that of the holder thereto, the articulated connections of the second linkage to the holder, the first linkage and the drive define a triangle, and the articulated connection of the first linkage to the bracket and that of the drive thereto are on either side of the articulated connection of the holder to the bracket.

7 Claims, 11 Drawing Figures

LINKAGE AND MOTION SYSTEM, ESPECIALLY FOR ACCOMPLISHING A SWINGING MOVEMENT IN EQUIPMENT SUCH AS BUCKETS FOR POWER SHOVELS AND THE LIKE

The present invention refers to a linkage and motion system, especially for accomplishing a swinging movement in equipment such as buckets for power shovels and the like.

With power shovels, the bucket must often have to carry out quite a complicated scheme of motion in order to work rationally. The manoeuvering possibilities for the bucket arm itself may be limited, and it is then a strong desire that the individual movement of the bucket is such that it can easily and flexibly be adapted to prevailing excavating and loading conditions.

This particularly applies to the oscillating movement of the bucket about a shaft which is generally horizontal, mounted at the outer end of the bucket arm and at right-angles to it. For loading work especially, there is the requirement that the bucket can oscillate about this shaft from a downwardly facing position when filling the bucket, to an upwardly facing position, whereafter the bucket and material are brought by the bucket arm into an emptying position, where the bucket is once again swung into a downwardly facing position for emptying. In such a case the bucket should be capable of an oscillating movement of at least 180° about the oscillating shaft.

The usual solution for power transmission in equipment of this kind is to use hydraulics. From a central operating unit in the driving cabin of the power shovel, pressure fluid is directed to different pressure cylinders for repositioning both bucket arm and bucket. In order to provide a sufficiently large oscillating movement for the bucket, constructions with two pressure cylinders have been necessary for action angles of 180° or more. In such solutions the pressure cylinders work consecutively, such that the second cylinder comes into action when the first stops working. However, constructions of this kind become complicated, from the point of view of manufacture and operation, and also have large space requirements.

The problem can be generally associated with the difficulties in providing a simple and effective linkage system using a single pressure cylinder to give the large action angle aimed at for the bucket, and simultaneously a sufficiently high turning moment for it in different angular positions. It is namely so that the turning moment on the bucket should be generally constant in different angular positions, with regard to the different tasks which must be carried out.

The present invention solves the problem of providing an oscillating movement of approximately 200° for the bucket, with an extremely simple linkage system and only one pressure cylinder, the variations in the turning moments being small at the same time, and lying well within acceptable limits in all conditions. According to one embodiment of the invention, the bucket is attached in a conventional way to the outer end of the bucket arm on a horizontal shaft at right angles to the arm. A pair of triangular link plates with three pivoting points, symmetrically and pivotally arranged on the bucket arm, function together with a pair of links as the power transmitting elements. The links are pin-jointed to the link plates and to the bucket. In a third pivoting point on the triangular link plates a pressure cylinder is oscillatably arranged, the end of the piston in the pressure cylinder being pivotably attached to the bucket via a piston rod head. Geometrically, the pivoting points for the links, the pivoting point of the link plates on the bucket arm, and the pivoting point of the latter on the bucket form a trapezium with sides of invariable lengths but with variable angles therebetween, the diagonals of the trapezium being varied by altering the position of the pressure cylinder piston rod for altered angular positions of the bucket during resettings.

The machine elements incorporated in the device are extremely simple. With the exception of the articulated attachment means between the link plates, the pressure cylinder is of standard design, and operation of the bucket via the pressure cylinder can take place with the assistance of conventional valves.

The characterizing features for the invention are apparent from the following patent claims.

An embodiment example according to the invention will now be described while referring to the attached drawings.

Figure 1:
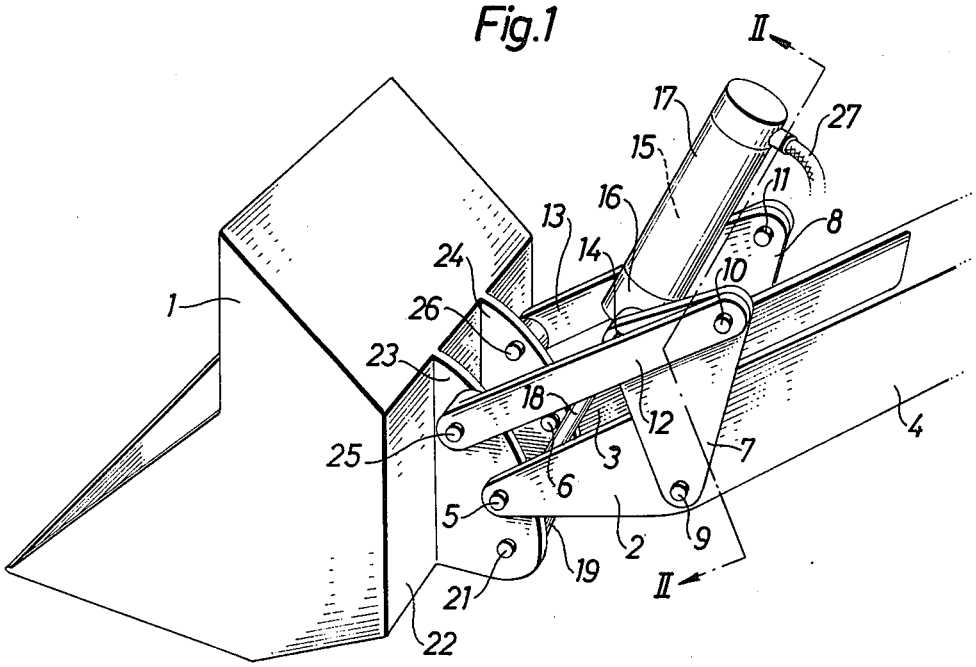
FIG. 1 shows, in a simplified way and in perspective, an outer end of a bucket arm on a power shovel, or the like, which has a bucket provided with the linkage system according to the invention, and an associated pressure cylinder.
Figure 5:
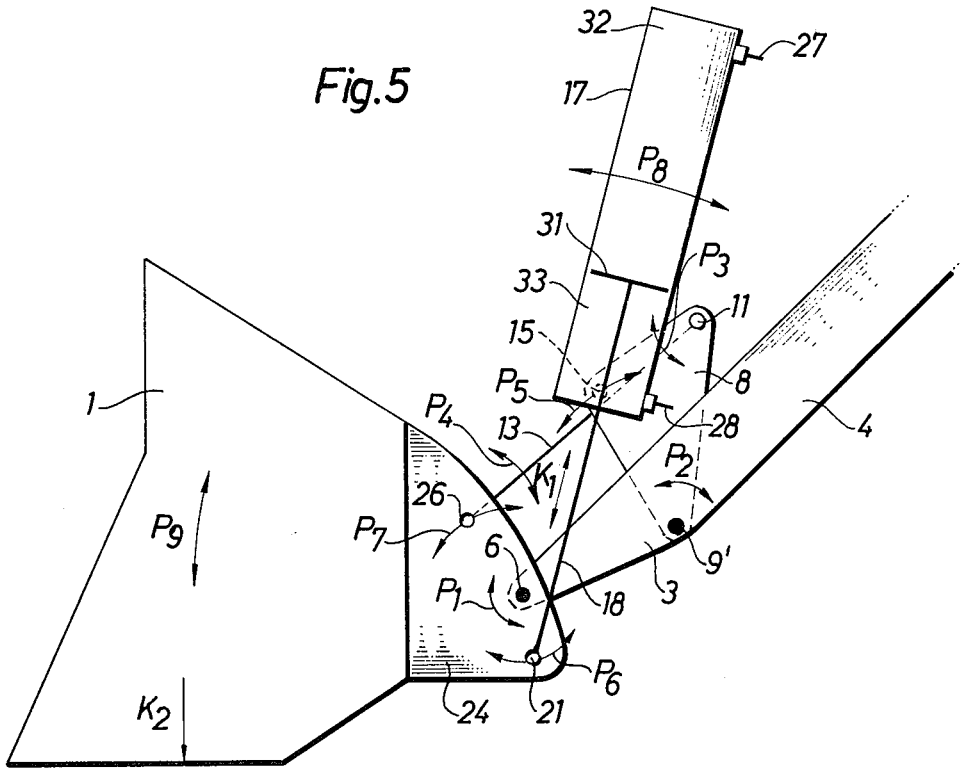
Figure 6:
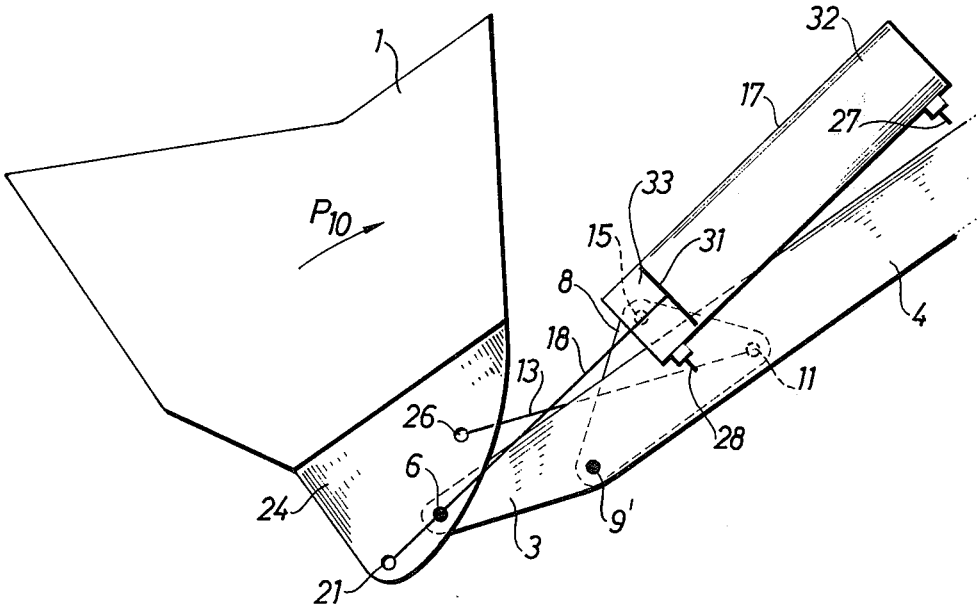
Figure 7:
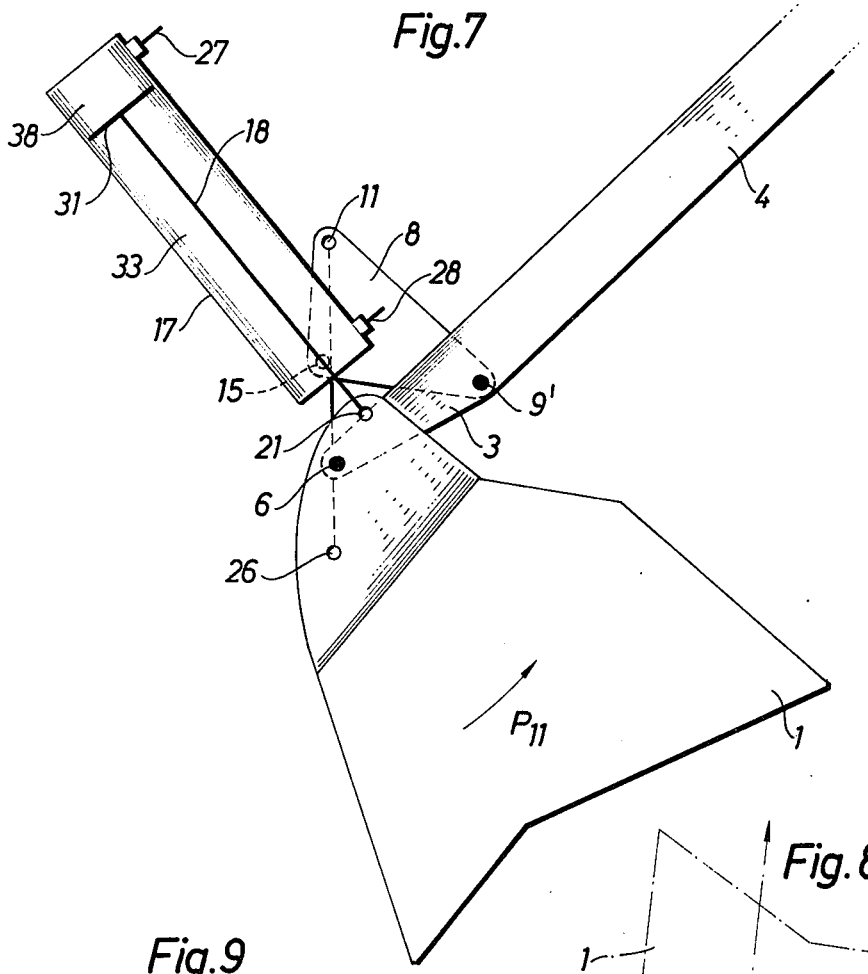

FIGS. 5, 6 and 7 indicate, heavily schematically, the motion of the linkage system according to FIG. 1, three different positions of the bucket in relation to the bucket arm being shown.

Figure 8:
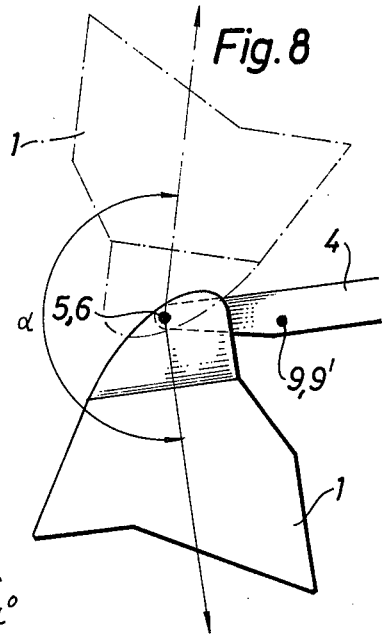
Figure 9:
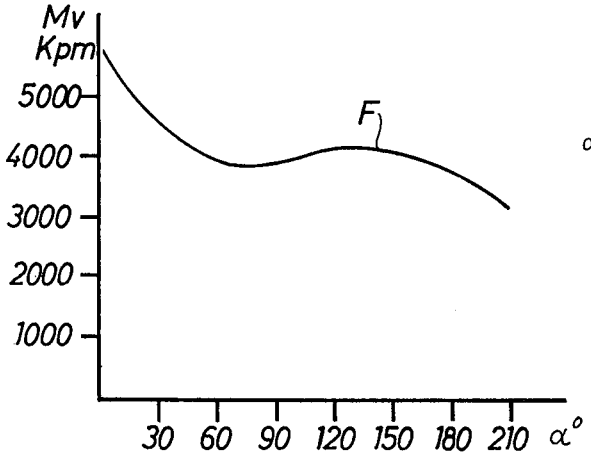

FIG. 8 shows, simplified and schematically, the position of the bucket in relation to the bucket arm in two extreme positions, and FIG. 9 shows graphically the variations in the turning moment on the bucket, according as a positional angle $\alpha$.

Figure 10:
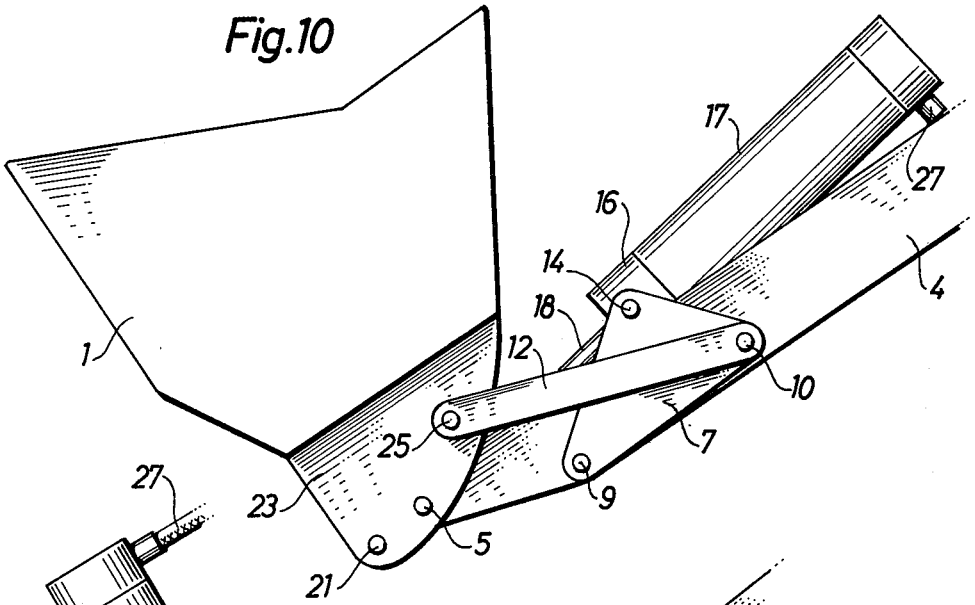
Figure 11:
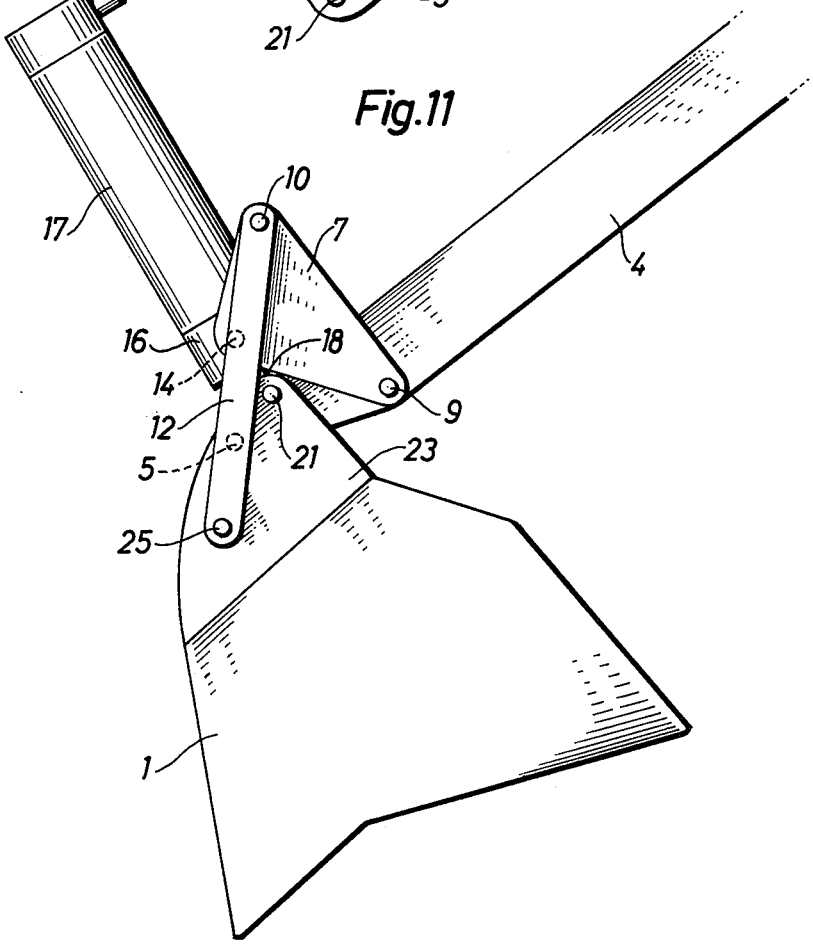

FIGS. 10 and 11 show, in particular conjunction with FIG. 1 and in elevation, the bucket with the linkage system and the bucket arm in two extreme positions for the bucket in relation to the bucket arm.

In FIG. 1 a bucket 1 is articulately connected to the outer limbs 2,3 of a bucket arm 4 by means of linkage pins 5,6. The bucket arm 4 can consist of a tubular beam with rectangular or quadratic section, and in FIG. 1 the outer end portion is shown shaped like a fork with the two limb ends 2,3. At a lower part of the limb ends 2,3 in the Figure, there are arranged two linkage pins for two link plates 7,8, one linkage pin 9 being visible in FIG. 1.

The link plates 7,8 are geometrically alike, and apart from the previously mentioned pivoting point 9, in the bucket arm 4, they have two further pivoting points with associated pins, comprising linkage pins 10,11 for a first end to a pair of links 12,13 and a pair of trunnions 14,15 on a cylinder attachment 16 for a pressure cylinder 17. The pressure cylinder 17 has a piston rod 18 which, with a piston rod head 19 and a locking nut 20 is articulately attached to the bucket 1 by means of a pin 21. As may be seen from FIG. 1, the bucket 1 is of conventional design with two carrying plates 23,24 rigidly attached to a rear face 22, there being linkage pins 5,6,21 arranged in the carrying plates. In a higher position in FIG. 1, in relation to the linkage pins 5,6 a pair of pins 25, 26 are arranged in the carrying plates 23,24 for a second end on each of the links 12,13.

Figure 2:
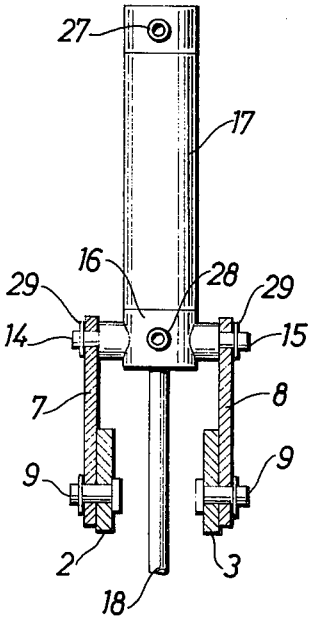
FIG. 2 shows, partly in section along the line II—II in FIG. 1, the pressure cylinder with trunnion attachment to the link plates associated with the linkage system.
Figure 3:
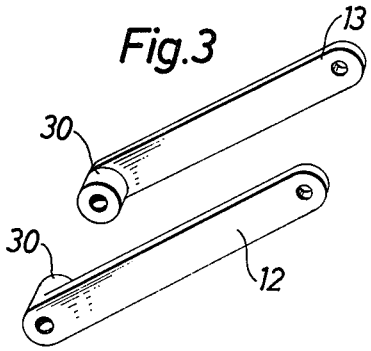
FIGS. 3 and 4 show, in perspective, details of the linkage system according to FIG. 1.
Figure 4:
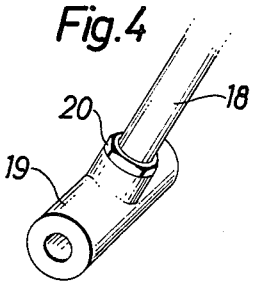

The motion for the system described will be clarified in greater detail in conjunction with FIGS. 5, 6 and 7. In FIG. 2 there is shown in elevation and partly in section along the line II—II in FIG. 1 the method of articulately attaching the pressure cylinder 17, which is arranged with two pressure lines 27,28, connected to a central operating unit in the power shovel cabin. The cylinder attachment 16 suitably consists of a portion integrated with the pressure cylinder 17, and made with trunnions 14,15 which are positively positioned in the link plates 7,8 by means of circlips 29 or the like. FIG. 3 shows in perspective the links 12,13 and indicates especially a boss or collar 30 arranged around the linkage pins 25,26, the collar functioning as a spacer to allow the free movement and power transmission for the system which will be described hereafter. FIG. 4 shows in perspective a detail of the piston rod 18, the piston rod head 19 and the locking nut 20.

In FIGS. 5,6 and 7 the described elements are shown schematically and heavily simplified while using the same designations as before. It is assumed for FIGS. 5, 6 and 7 that the bucket arm 4 is in substantially the same position, but that the bucket 1 assumes three completely different positions in relation to the bucket arm 4. For the sake of clarity FIGS. 5–7 are shown as projections at section through the pressure cylinder 17. The different linkage pins indicated in the figures are thus a linkage pin 9' for the link plate 8 and has the two further linkage and trunnion pins 11,15, respectively, in it, the pins 6,21,26 in the carrying plate 24 also being shown. The position of the bucket 1 in relation to the bucket arm 4 is shown in FIG. 5 in approximately the same position as in FIG. 1. The bucket 1 can then oscillate in relation to the bucket arm 4 about the pins 5,6 according to the double arrow P1. By means of the articulated joints which the link plates 7,8 and the links 12,13 achieve between the carrying plates 23 and 24, i.e. the bucket 1 and the bucket arm 4, the link plates 7,8 (FIG. 1 in combination with FIGS. 5–7) will oscillate about the pins 9,9' according to the double arrow P1, simultaneously as the links 12,13 at the articulation points 10,11 and 25,26, respectively, oscillate according to the double arrows P3 and P4 respectively. At the same time the trunnions 14,15 for the cylinder attachment 26 make an arcuate movement according to the double arrow P5 with the linkage pins 9,9' as centre. With the linkage pins 5,6 as centre the pins 21 and 25,26 travel arcuately according to the double arrows P6 and P7 respectively.

It will be understood that the pressure cylinder 17, by means of the articulated joint of the piston rod 18 with the pin 21, describes a geometrically comparatively complicated travel and oscillating motion with the trunnions 14,15 as travel and pivoting axis. The main direction for this combined motion of the pressure cylinder 17 is denoted by the double arrow P8.

In conjunction with the piston rod 18 there is a piston 31 working in the pressure cylinder 17, as shown in FIGS. 5–7, with pressurized cylinder chambers 32,33 on either side. In response to the pressure conditions in the cylinder chambers 32,33 the piston rod 18 will be actuated by forces according to the double arrow K1, in its turn providing a setting movement which turns the bucket 1 about the linkage pins 5,6 according to the double arrow pin 9, said pins also supporting a mass K2 accommodated in the bucket.

If, in the position of the linkage system shown in FIG. 5, further pressure medium is supplied to the cylinder chamber 32 through the pressure line 27 simultaneously as pressure medium is removed from the cylinder chamber 33 by means of the pressure line 28, the bucket 1 will oscillate about the pivoting points 5 and 6 according to the arrow P10, up to the raised position according to FIG. 6, the piston 31 moving to a bottom position in the pressure cylinder 17 at the same time. The pressure cylinder will then swing in towards the bucket arm 4. To enable free movement of the pressure cylinder 17 to this extreme position, the bucket arm 4 is, as has been previously mentioned, shaped as a fork with a sufficient opening for the oscillating movement of the pressure cylinder 17. In the position according to FIG. 6, the bucket is practically completely directed upwardly and can then be filled with material.

If, in the position according to FIG. 6, pressure medium is supplied to the cylinder chamber 33 instead, at the same time as pressure medium is removed from the cylinder chamber 32, the bucket 1 will oscillate downwardly about the linkage pins 5,6 according to the arrow P11, to assume a final position as shown in FIG. 7, for emptying material from the bucket. It wll be noted that the bucket arm 4 has had the same angular position to a horizontal plane the whole time during these operations with the bucket 1, and thus does not need to be manoeuvered to bring the bucket into the positions shown, which are advantageous from the point of view of loading and unloading.

The motion in the desired linkage system is clear from the FIGS. 5,6 and 7, while on the other hand an analysis of the force relationship in the different elements and the resulting turning moment on the bucket 1 about the linkage pins 5,6 is very complicated. The turning moment for the bucket 1 must obviously be sufficiently large in all positions to overcome the load forces K2 (FIG. 5) which can arise, and also all the forces which will be transformed to turning moments on the bucket 1 during excavating or shovelling work. It is also clear that the turning moment on the bucket 1 is related to the positional relationship between the different pivoting points, the size of the pressure cylinder 17 and the pressure distribution in the cylinder chambers 32,33. Purely geometrically, as is most clear in FIG. 5, the pins 5,6,9,9',10,11,25,26 form between the bucket 1 and the bucket arm 4 a trapezium with sides of constant length but with variable diagonals. The diagonal variations are achieved by the forces K1 via the piston rod 18. It should be mentioned here that the comparison with a trapezium is not completely adequate for all phases of motion in the linkage system. In a certain position the above-mentioned pins form a geometrically undefinable four-sided figure, which is most clearly apparent from FIG. 7, when the side of the trapezium formed by the linkage pins 5,6 and 25, 26 respectively, is folded inwardly towards the trapezium.

With the object of giving a true picture of the variations in the turning moment on the bucket, the basic data for a given embodiment of the linkage system has been fed into and analyzed by a computer. The geometrical relationship in relation to the positions of the different pins as shown in the figures has been generally followed. The result obtained is shown graphically in FIG. 9, a positional angle $\alpha$ being schematically shown by FIG. 8. In FIG. 9 the turning moment Mv is given in kpm along the Y-axis of the diagram, and the positional angle $\alpha°$ along the X-axis. As may be seen from a function graph F in FIG. 9, the turning moment Mv is at a high level, i.e. at an average of 4000 kpm, simultaneously as the variations are comparatively moderate, with a maximum value of approximately 5500 kpm when $\alpha=0$, i.e. when the bucket is in a downwardly extreme position, (FIG. 7), and a minimum value of approximately 3500 kpm for $\alpha=200°$, i.e. when the bucket is directly upwardly according to FIG. 6.

In order further to clarify the positions of the different linkage elements at both of these extreme positions, side projections according to FIGS. 10,11 are shown, which illustrate in a simplified manner the linkage system in conjunction with the embodiment shown in FIG. 1. The designations are the same as previously used for the different parts, and functional descriptions further to what has already been said ought not to be required in conjunction with FIGS. 10,11. It may be clearly seen from said Figures that in the upwardly facing position of the bucket (FIG. 10) the piston rod 18 practically passes through the point of attachment 5 of the bucket to the bucket arm 4, which means that the moment arm between the bucket and cylinder is practically zero. However, the necessary moment arm is achieved by the attachment of the cylinder to the link plates 7,8, and their attachment to the bucket arm 4. In the most downwardly turned position (FIG. 11) there is practically no moment arm in the connection between the link plates 7,8, links 12,13 and the bucket 1, since the link arms are over the pivoting point 5 of the bucket. In the latter position there is a moment arm between the attachment point 21 of the piston rod 18 and the pivoting point 5 of the bucket.

Within the scope of the invention it is naturally not necessary for a bucket 1 to be attached to the linkage system, and any kind of equipment whatsoever can be fastened thereto, said equipment, for example, requiring a large swinging movement for carrying out a necessary working operation. Neither it is necessary to mount a pressure cylinder as a driving means, as is shown in the example, and any other source of power or tool, capable of carrying out the equivalent operational movements may be used.

In FIGS. 1–4 and 10,11 the different elements in the linkage system have, as has been mentioned earlier, been shown in a simplified nearly principle construction. In practice, all pins must, for example, be well protected against the intrusion of dirt and moving particles. It must also be understood that the link plates 7,8 can be made as bell cranks and that the remaining elements can be suited in design to other embodiments of the linkage system without departing from the scope of the invention.

What I claim is:

1. A linkage and motion system especially for oscillating equipment such as buckets to excavators and the like, the equipment or its attachment being pivotably attached to a holder, characterized by a first linkage device connecting said attachment with a second linkage device which in turn is articulately joined to said holder, between said second linkage device and said attachment there being articulately attached a driving means with a linear working motion, said driving means being articulately attached to the attachment at a point at a distance from the articulation points of the holder to the attachment, the articulation points of said second linkage device being so situated that they geometrically form the corner points in a triangle, the articulation points for said first linkage means at the attachment and the articulation points for the driving means at the attachment being on either side of the articulation point of the attachment to the holder.

2. A linkage and motion system as claimed in claim 1, characterized in that the travel of the driving means and said first linkage means are arranged in crossing directions in all pivoting positions.

3. A linkage and motion system as claimed in claim 1, characterized in that the articulation point for said second linkage device to said first linkage device is situated past the articulation point for the driving means in relation to the articulation point of said second linkage device to the holer and to the articulation point of the attachment to the holder.

4. A linkage and motion system as claimed in claim 1, characterized in that said first linkage device, said second linkage device, the attachment and the holder together with their articulation points geometrically form a trapezium with constant sides, but with diagonals varying as the angular position of the attachment in relation to the holder.

5. A linkage and motion system as claimed in claim 1, applied for example to a power shovel bucket, oscillatable in a vertical plane about a turning axis at an outer end of the bucket arm of a power shovel, characterized in that said first linkage device consists of two parallel links with equal distances between the first and second linkage pins and that said second linkage device comprises two generally triangular link plates in which said second and a third linkage pin and a first pivotable power transmission pin for the driving means is geometrically congruently arranged at the corner points in a triangle, the oscillating axis and the first mounting pin consisting of linkage pins which together with the second pivotable power transmission pin are arranged in parallel carrying plates which are rigidly attached to the bucket.

6. A linkage and motion system as claimed in claim 5, characterized in that the bucket arm is shaped like a fork at its outer end, with a length of the fork arms allowing a free swinging movement for the driving means.

7. A linkage and motion system as claimed in claim 1, characterized in that the driving means consists of a preferably hydraulic piston-cylinder mechanism.

* * * * *